US011267635B2

(12) United States Patent
Kellerer

(10) Patent No.: US 11,267,635 B2
(45) Date of Patent: Mar. 8, 2022

(54) CONTAINER WITH VALVE ASSEMBLY

(71) Applicant: SCHOELLER ALLIBERT GMBH, Schwerin (DE)

(72) Inventor: Richard Kellerer, Feldkirchen (DE)

(73) Assignee: SCHOELLER ALLIBERT GMBH, Schwerin (DE)

( * ) Notice: Subject to any disclaimer, the term of this patent is extended or adjusted under 35 U.S.C. 154(b) by 0 days.

(21) Appl. No.: 16/962,754

(22) PCT Filed: Jan. 18, 2018

(86) PCT No.: PCT/EP2018/051239

§ 371 (c)(1),
(2) Date: Jul. 16, 2020

(87) PCT Pub. No.: WO2019/141367

PCT Pub. Date: Jul. 25, 2019

(65) Prior Publication Data

US 2020/0354133 A1 Nov. 12, 2020

(51) Int. Cl.
*B65D 77/30* (2006.01)
*B65D 77/06* (2006.01)

(52) U.S. Cl.
CPC ..... *B65D 77/30* (2013.01); *B65D 77/061* (2013.01)

(58) Field of Classification Search
CPC ..... B65D 47/20; B65D 47/25; B65D 77/04; B65D 77/06; B65D 77/061; B65D 77/30; F16K 27/00; F16K 27/04
USPC ..... 206/386
See application file for complete search history.

(56) References Cited

U.S. PATENT DOCUMENTS

| | | | | |
|---|---|---|---|---|
| 5,947,171 | A | 9/1999 | Woodruff | |
| 9,139,345 | B2 * | 9/2015 | Knutsson | B65D 47/20 |
| 10,164,227 | B2 * | 12/2018 | Hofer | H01M 50/333 |
| 2014/0231689 | A1 | 8/2014 | Knutsson | |

FOREIGN PATENT DOCUMENTS

| | | | | |
|---|---|---|---|---|
| CA | 1151609 | A | 8/1983 | |
| CN | 103906954 | A | 7/2014 | |
| DE | 69829599 | | 2/2006 | |
| EP | 2894111 | A1 | 7/2015 | |
| GB | 2188305 | A | 9/1987 | |
| GB | 2448236 | A * | 10/2008 | F16K 27/045 |

(Continued)

OTHER PUBLICATIONS

International Search Report received in International Application No. PCT/EP2018/051239 dated Oct. 9, 2018, 3 pages.

(Continued)

*Primary Examiner* — Bryon P Gehman

(57) ABSTRACT

A container, preferably a pallet container with a liner bag, includes a base, at least one side wall, and an exchangeable valve assembly that can be mounted in an insertion direction into a valve socket in the container. The container includes at least one locking element for locking engagement of a locking structure of the valve assembly and which is movably mounted in or on the container and can be moved between an open position, in which the valve assembly can be inserted into or removed from the valve socket, and a closed position, in which the locking element engages the locking structure of the valve assembly to secure it inside of the valve socket.

16 Claims, 8 Drawing Sheets

(56) References Cited

FOREIGN PATENT DOCUMENTS

| | | | |
|---|---|---|---|
| JP | H05221462 | A | 8/1993 |
| WO | 2014006445 | A1 | 1/2014 |

OTHER PUBLICATIONS

Written Opinion of the International Searching Authority received in International Application No. PCT/EP2018/051239 dated Oct. 9, 2018, 7 pages.
Search Report received in Chinese Application No. 201880091497.9 dated Nov. 9, 2021, with translation, 6 pages.
Office Action received in Chinese Application No. 201880091497.9 dated Nov. 17, 2021, with translation, 10 pages.

* cited by examiner

CONTAINER WITH VALVE ASSEMBLY

CROSS REFERENCE TO RELATED APPLICATION(S)

This application is the United States national phase entry of International Application No. PCT/EP2018/051239, filed Jan. 18, 2018, the content of which is incorporated by reference herein in its entirety.

FIELD

The invention relates to a container, preferably a pallet container with a liner bag, comprising an exchangeable valve assembly, which can be mounted in an insertion direction into a valve socket provided in the container. The invention further relates to a valve assembly and a locking element for such a container.

BACKGROUND

In pallet containers with liner bags, it is state of the art to utilize exchangeable discharge valves, which can either be discarded with the liner bag after emptying of the container or be cleaned and reprocessed, in order to avoid the contamination of any fluids, granulated goods or the like, which are subsequently transported with the same container. In order to provide easy exchangeability, the valve assemblies known in the art usually comprise integrally formed latching hooks, which may be snapped into corresponding recesses in the container or vice versa. This allows for toolless assembly and disassembly of the valve on the container and reduced production steps, when producing the container. However, these known solutions have several drawbacks. For one, the disassembly can be cumbersome, since the latching hooks have to be unlatched manually, which requires the use of both hands and bending down to reach the valve assembly near ground level. Further, the known latching mechanisms pose a hazard for jamming ones fingers during assembly or disassembly of the valve. Finally, the known solutions are susceptible to damage, especially when disassembling the valve from the container. Specifically, the latching hooks tend break, which can render the valve useless and also bears the risk of clogging up the corresponding recesses in the container. Thus, the known containers are at a continual risk of being rendered out of commission during routine exchange of the valve assembly.

SUMMARY

Because of the above stated disadvantages in the state of the art, the goal of the present invention is to provide a sturdier locking mechanism for releasable securing of a valve assembly in a container, which allows for easy assembly and disassembly.

In accordance with the invention there is provided a container, especially a pallet container with a liner for the transport and storage of liquid, granulated, powdered, viscous or paste-like goods, comprising an exchangeable valve assembly, which can be inserted (mounted) in an insertion direction into a valve socket provided in the container. The container comprises at least one (separate) locking element (locking member, latch), which is configured for locking engagement of a locking structure of either the valve assembly or the valve socket and which is movably mounted in or on the container or the valve socket and can be moved, between an open (releasing) position, in which the valve assembly can be inserted into or removed from the valve socket; and a closed (locking) position, in which the locking element engages the locking structure, in order to secure the valve assembly inside of the valve socket. In other words, a separate and exchangeable locking element is provided in the container according to the invention, which can secure the valve assembly inside the valve socket in a form-locking manner in a first closed position and can be moved into a second open position in which it does not engage the valve assembly, thereby enabling insertion or removal of the valve assembly into/from the valve socket. Preferably, the movement direction of the locking element is perpendicular to the insertion direction of the valve assembly into the valve socket. The above described container is less susceptible to damage than container arrangements known in prior art and further provides the advantage that damage to the container itself during assembly or disassembly of the valve is avoided. Even in a worst case scenario, in which the locking element is damaged during assembly or disassembly of the valve, the container itself remains undamaged and it is possible to simply replace the locking element while keeping the container in service, which is cheaper by multiple orders of magnitude.

According to a further aspect of the invention the locking element can be biased into the closed position by a biasing element. This biasing element can preferably be some sort of spring, in particular it may be a leaf spring which is integrally formed with the locking element. Through such design of the container, secure locking of the valve assembly inside the valve socket may be assured. Integrally forming the biasing element into the locking element allows for easier replacement/assembly of this component.

According to a preferred embodiment of the invention the locking element may be made of polymer material (plastic). Advantageously the locking element may be formed in one piece, e.g. in an injection molding process. Such construction of the locking element allows for efficient mass production thereof, such that the locking element can be treated as a wear part. Similarly the container and the valve assembly may also be made of polymer (plastic) material, preferably in an injection molding process. A preferred material for the valve assembly are thermoplastic plastics and the like with a rubber plastic (elastomer) portion for sealing.

According to a further aspect of the invention the locking element and/or the locking structure can comprise a first guide surface (a first pair of guide surfaces), which forceably actuates a movement of the locking element from the closed position into the open position, when the valve assembly is inserted into the valve socket in the insertion direction with a predetermined insertion force. In other words, the first guide surface or the first guide surfaces may engage such that the locking element slides into the open position as a result of the insertion movement of the valve assembly. This may be accomplished e.g. by guide chamfers or similar (e.g. rounded) surface structures, which can convert a portion of the insertion force into a force which translates into movement of the locking element (against the biasing force of the biasing element). Such design of the locking element and the locking structure allows for ergonomic (self-locking) mounting of the valve onto the container by simply "clicking" it into the valve socket. In case that guide chamfers (notches) are used as guide surfaces, it is preferred that these form an angle between 35° and 45° with the insertion direction or the longitudinal axis of the valve respectively.

According to a preferred embodiment of the invention the locking element and/or the locking structure can comprise a second guide surface, which forceably actuates a movement of the locking element from the closed position into the open position, when the valve assembly is moved out of the valve socket contrary to the insertion direction with a predetermined removal force. In other words the valve assembly may be snapped out of the valve socket past the locking element, when sufficient force is applied in the direction opposing the insertion direction (inwards). This feature allows for an ergonomic disassembly of the valve by, e.g. a kicking against it, while at the same time avoiding damage to the locking parts through the compliance of the locking element.

According to a further aspect of the invention the first guide surface and the second guide surface are designed such that the predetermined removal force is greater than the predetermined insertion force. This may preferably be achieved by designing the second guide surface such that its angle relative to the insertion direction is flatter than the angle of the first guide surface relative to the insertion direction. Accidental disassembly of the valve may be inhibited by designing the second guide surface(s) such that the force required for disassembly is considerably higher than that required for assembly.

According to a preferred embodiment of the invention the valve assembly is inserted into the valve socket through a tilting movement. This feature allows for more ergonomic assembly and also decreases the chances of accidental disassembly because the disassembly force has be applied targetedly to a smaller area of the valve (located opposite of the fulcrum of the tilting movement). In order to implement said feature, the valve socket may comprise a guiding groove which can interact with a guiding protrusion, preferably a flange, of the valve assembly, in order to guide the tilting insertion movement. In such an embodiment the locking element may preferably be positioned on the opposite side of the valve socket with respect to the fulcrum of the tilting movement.

According to a preferred embodiment of the invention the insertion direction is directed from the inside of the container towards the outside of the container. This is advantageous for an application with liner bags, since the valve is inserted into the container together with the liner bag. Furthermore, with such design the valve can be simply kicked towards the container interior for disassembly, allowing for more ergonomic handling of disassembly operations.

According to a further aspect of the invention the locking structure of the valve assembly comprises at least one locking protrusion, which engages with the locking element. Preferably the locking protrusion may protrude in a front direction (in the insertion direction) of the valve assembly (outward direction, when assembled into the container). Further preferably, the said locking protrusion may comprise a further projection protruding away from the frontward protrusion in order to be engageable with the locking element. It is further advantageous, if the locking structure is arranged in an upper edge portion of the valve assembly (above the tube of the valve).

According to an aspect of the invention the valve assembly may comprise at least two locking protrusions and/or recesses, which form the locking structure for engaging with the locking element. The at least two locking protrusions and/or recesses may preferably be arranged symmetrically with respect to a central axis or plane of the valve assembly. Further preferably the at least two locking protrusions and/or recesses may be located in proximity to the lateral edges of a valve main body or a flange of the valve.

According to a preferred embodiment of the invention the locking element can be slideably mounted within a slide bearing, e.g. a guiding rail or groove or track arranged in the container (adjacent to the valve socket). By such implementation of the locking element as a slider, it can be easily assembled into the respective guiding rail or groove (recess) provided in the container. However the implementation of a rotating locking element is also possible and contemplated. Preferably such a rotating locking element may be biased into the closed position by means of a torsion spring or the like.

According to a further preferred aspect of the invention the valve socket may be configured such that it defines a predetermined contact surface which acts as a limit stop for the valve assembly. Along the same line, the valve assembly may comprise a defined surface, preferably a flange, for contacting the contact surface of the valve socket. Advantageously a main flange of the valve assembly may support the valve against a surface adjacent to an opening of the valve socket. In such an embodiment, the locking element and the locking structure of the valve assembly may be designed such that they remain in contact and the locking element pins the valve assembly against the predetermined contact surface, when the valve assembly is inserted into the valve socket, to provide a more secure seating of the valve inside the container. One could also say that the locking element can provide a clamping force by means of the biasing element, which clamps the valve assembly in place.

According to a further aspect of the invention the locking element may comprise a lever portion, which is accessible from the outside of the container for manually moving the locking element from the closed position into the open position. This allows for an even better wear-protection disassembly, when compared to the disassembly by kicking. Compared to the solutions known in the art, a locking member, which may be operated manually from the outside provides the advantage that it can be operated with one hand while at the same time reducing the risk of jamming ones fingers during disassembly.

According to a preferred embodiment of the invention, the valve socket may be located in proximity to the base of the container. In such an embodiment a recessed portion may be provided in the base of the container in which the valve assembly may be inserted such that at least a portion of the valve lies below the (inner/upper) base level of the container to facilitate complete emptying of the container contents.

According to another aspect of the invention a valve assembly is provided, which is intended for insertion into a valve socket of a container comprising a locking element and movable between an open position, in which the valve assembly can be inserted into or removed from the valve socket; and a closed position, in which the locking element engages the valve assembly, in order to secure it inside of the valve socket. Said valve assembly comprises a locking structure which is adapted for engaging the locking element of the container, such that the valve assembly may be secured in the valve socket by the locking element.

Alternatively, the locking element may also be provided on the valve assembly and movable between a closed position, in which it engages a locking structure of the container, in order to secure the valve inside the valve socket and an open position, in which the locking element is disengaged from the locking structure and the valve assembly may be inserted into or removed form the valve socket.

Preferably the valve assembly may be configured to be associated with a liner bag, i.e. through a flange at its inner edge portion.

According to yet another aspect of the invention locking element is provided, which is adapted to be slideably mounted within a guiding rail or groove located adjacent to a valve socket of a container, such that it is moveable (slideable) between an open position and a closed position. Preferably the locking element may be biased into the closed position by a biasing element. In a preferred embodiment, the biasing element may be an integral part of the locking element providing sufficient elasticity, e.g. a leaf spring. Advantageously, the locking element may be injection molded in one piece, preferably from POM. Other preferred materials for the slider are Acrylonitrile butadiene styrene (ABS) or high density polyethylene (HDPE).

In summary one could say that the inventive idea is to provide a separate movable locking element or latching member on a container, which provides a robust and easy to handle latching mechanism for fastening an exchangeable valve inside a valve socket.

BRIEF DESCRIPTION OF THE DRAWING FIGURES

Embodiments of the invention will now be described by way of example and with reference to the accompanying drawings, in which.

DETAILED DESCRIPTION

Figure 2:
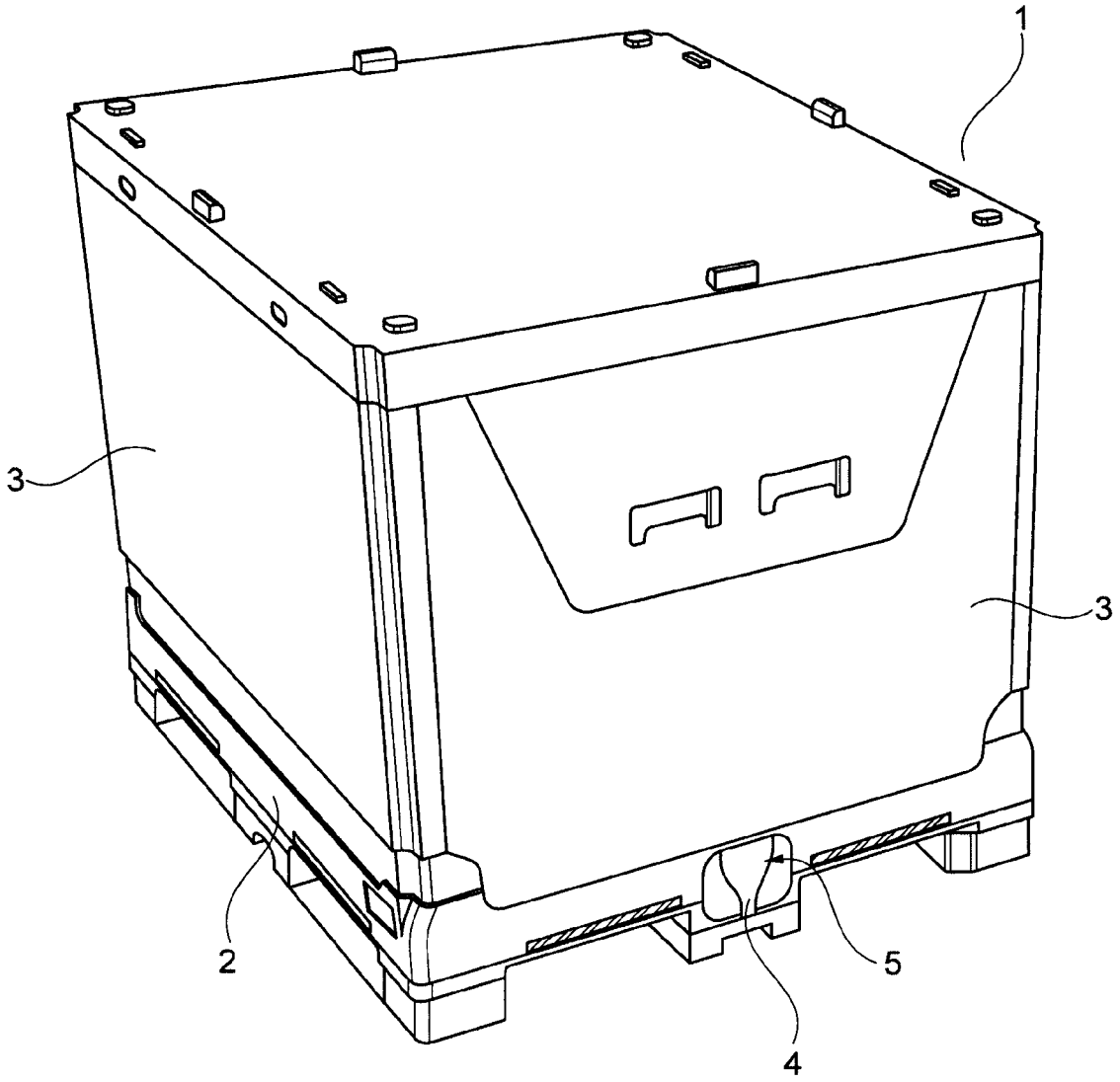
FIG. 2 shows a perspective view of a container according to the preferred embodiment of the invention.

FIG. 2 shows a perspective view of a container 1 according to an exemplary embodiment of the present invention. In particular, a pallet container 1 is shown, having a base 2 with a pallet structure, which is suitable for transport with a forklift or the like, and four foldable side walls 3. A liner bag (not shown) may be placed inside the pallet container 1 for secure transportation of liquid, granulated, powdered, viscous, paste-like goods or the like. The liner bag comprises a valve assembly 4 in proximity to its lower side, which can be securely inserted into the valve socket 5 provided laterally in a lower part of a side wall 3 at base level of the container 1.

Figure 1:
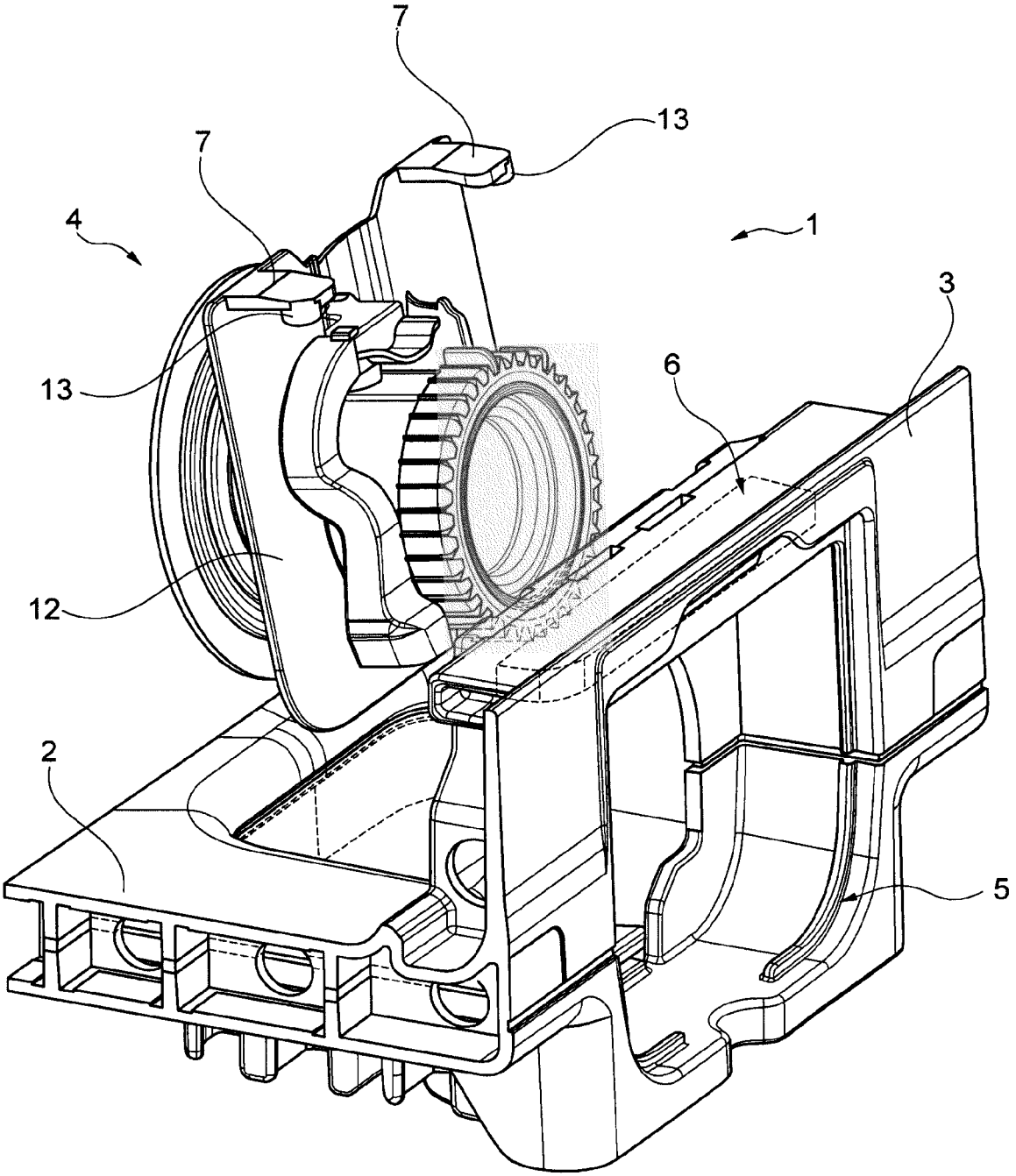
FIG. 1 shows a perspective view of a valve assembly prior to insertion into a valve socket of a container according to a preferred embodiment of the invention.

FIG. 1 depicts a perspective view of the valve socket 5 area of the container 1 according to a preferred embodiment of the present invention together with a valve assembly 4, which is ready for assembly inside the valve socket 5. In the depicted embodiment the valve socket 5 is arranged in a recessed portion of the base 2 (below the upper face level of the base 2), in order to allow for complete discharge of the liner bag contents through the valve assembly 4, once inserted and assembled. The depicted valve assembly 4 and valve socket 5 implement a novel type of securing/locking mechanism for securing/locking the valve assembly 4 inside the valve socket 5. This mechanism relies on a movable locking element (slider) 6, which is movably mounted on the container 1 (above to the valve socket 5) and movable between a closed position (left position in a frontal view) and an open position (right position in a frontal view). The locking element 6 is configured to secure the valve 4 inside the valve socket 5, when the valve assembly 4 is positioned therein and the locking element 6 is positioned in the closed or locking position. This is achieved by engagement of the locking element 6 with locking structures 7 arranged on the valve assembly 4. The locking element 6 is biased into the closed position by a biasing element 8, such that the locking mechanism is self-locking. In order to enable simple and one-handed snap-fit assembly/disassembly of the valve 4 into/onto the container 1, the locking element 6 and the locking structure 7 of the valve 4 engage through a pair of first guide surfaces 9 and a pair of second guide surfaces 10, which cause the locking element 6 to yield, if the valve 4 is moved into or out of the valve socket 5 in a certain direction and with sufficient force. Through such design, a robust securing/locking mechanism is provided, which additionally allows for easy assembly and disassembly of the valve 4 by either simply clicking it into or out of the valve socket 5 or by clearing the path for movement of the valve 4 by moving the locking element 6 out of the way (into the open position) manually via a lever 15. The exact functioning and design of the above mentioned securing/locking mechanism according to the preferred embodiment of the invention is described in greater detail in the following.

From FIG. 1 it is apparent that the base 2 of the container 1 is formed by an upper base section and a lower base section, which are welded together. The upper base section forms a circumferential base wall, to which the side walls 3 are attached in which the locking element 6 is mounted, as can be seen in FIGS. 1 and 2. The upper and lower base section also form/define the valve socket 5 together.

Figure 4:
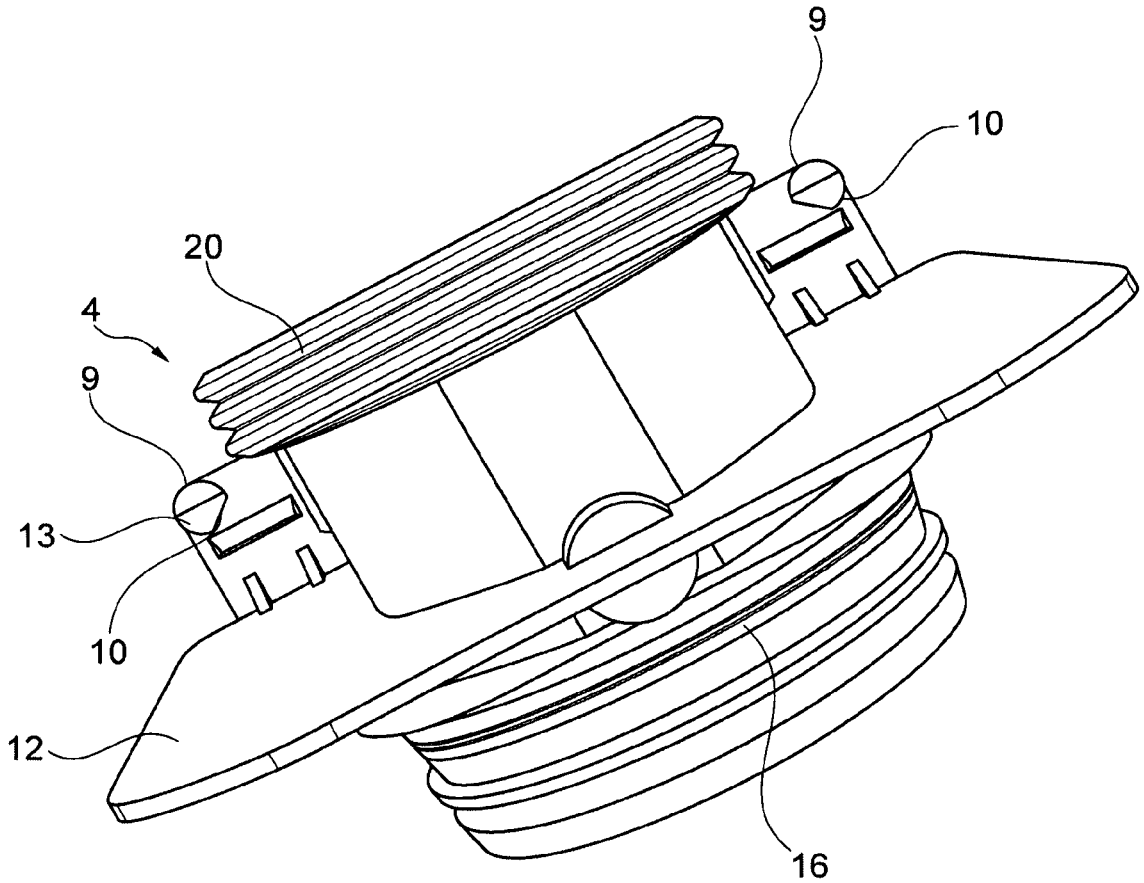
FIG. 4 shows a perspective view of the valve assembly according to the preferred embodiment.
Figure 5:
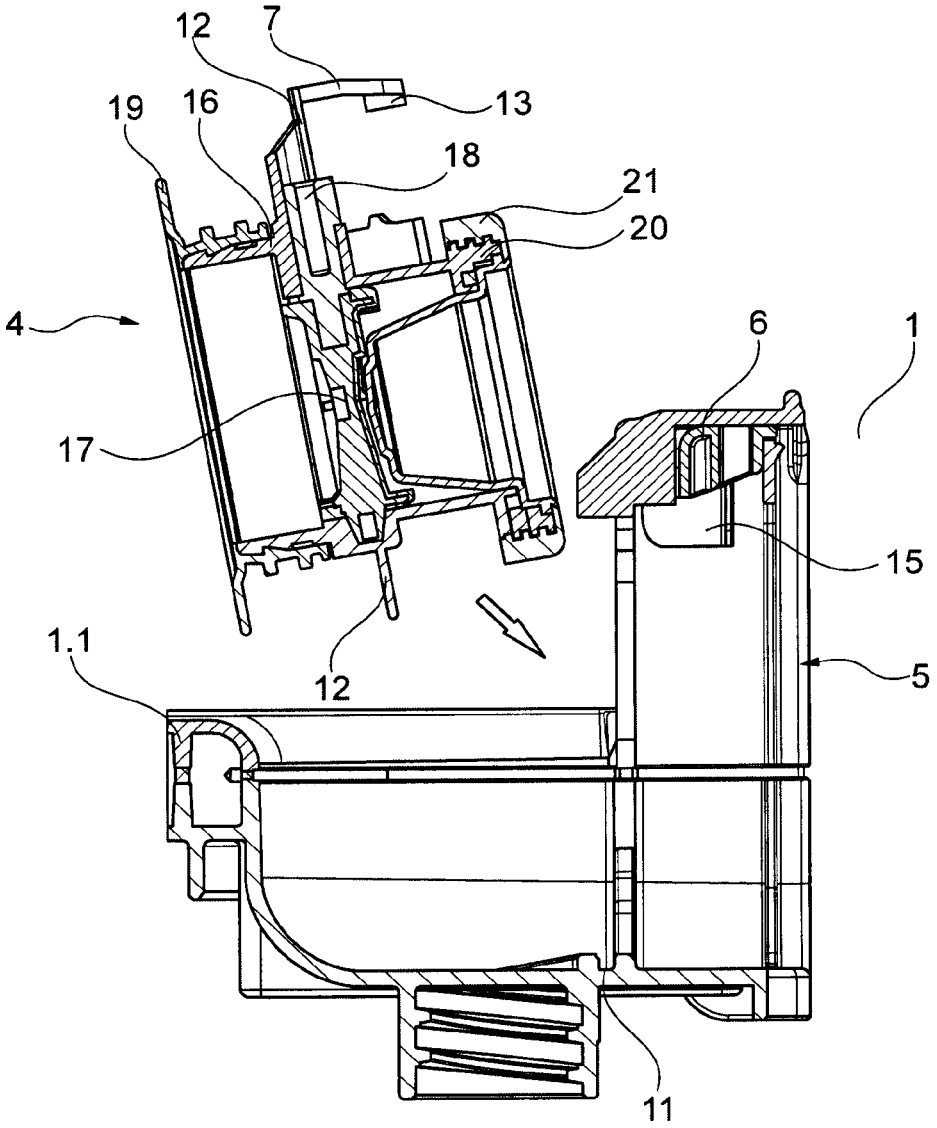
FIG. 5 shows a sectional view of the valve assembly prior to insertion into the valve socket of the container according to the preferred embodiment of the invention.
Figure 6:
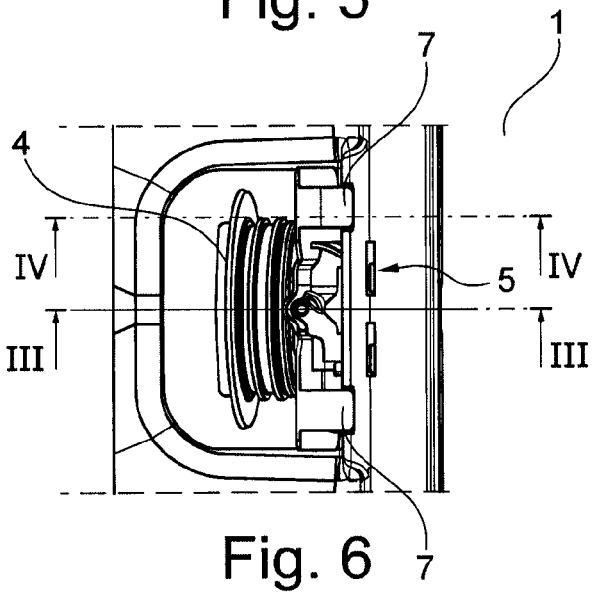
FIG. 6 shows a top view of the valve assembly prior to insertion into the valve socket of the container according to the preferred embodiment of the invention.

As best seen in FIGS. 4 and 5, the valve assembly 2 of the preferred embodiment is configured as a butterfly valve with a tube shaped main body 16 (in this example made from a thermoplastic material with a rubber plastic for sealing), a valve disc 17, a valve axle 18 with a lever portion, an inner flange 19, which is attached (attachable) to the liner bag, a main or middle flange 12, and an outer threaded portion 20, on which a cap 21 can be screwed. As the skilled person will appreciate, the valve assembly 4 can just as well be configured as a ball valve or any other suitable valve type. Since the valve assembly 4 is inserted into the interior of the container 1 together with the liner bag, the insertion direction (I) of the valve assembly 4 into the valve socket 5 is directed outwards.

Figure 7:
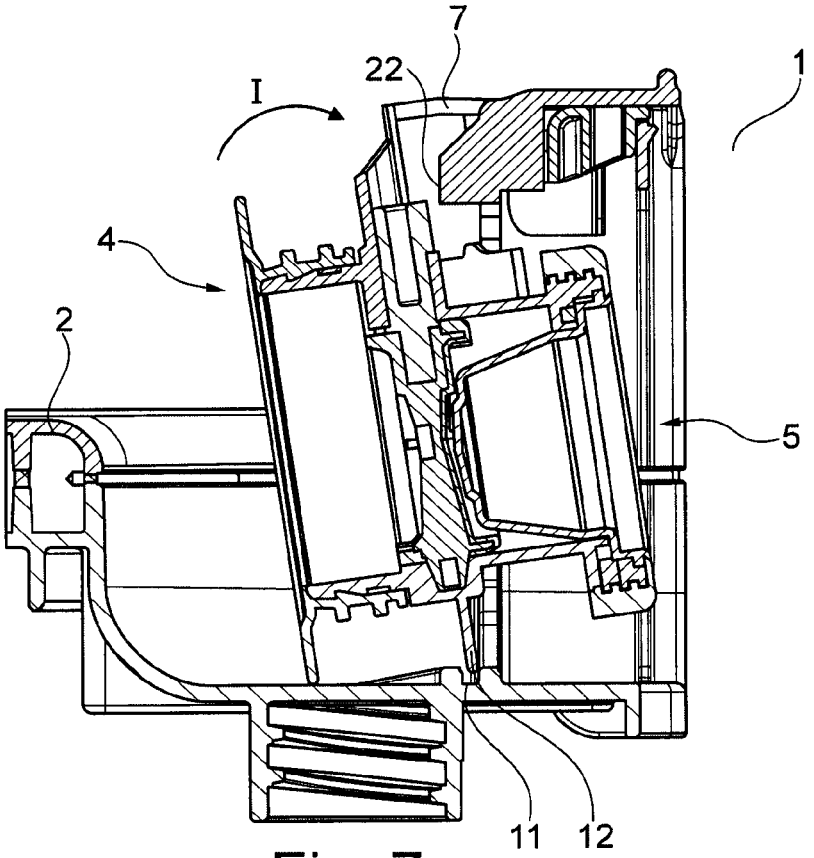
FIG. 7 shows a first sectional view of the valve assembly immediately before insertion into the valve socket of the container according to the preferred embodiment of the invention.
Figure 9:
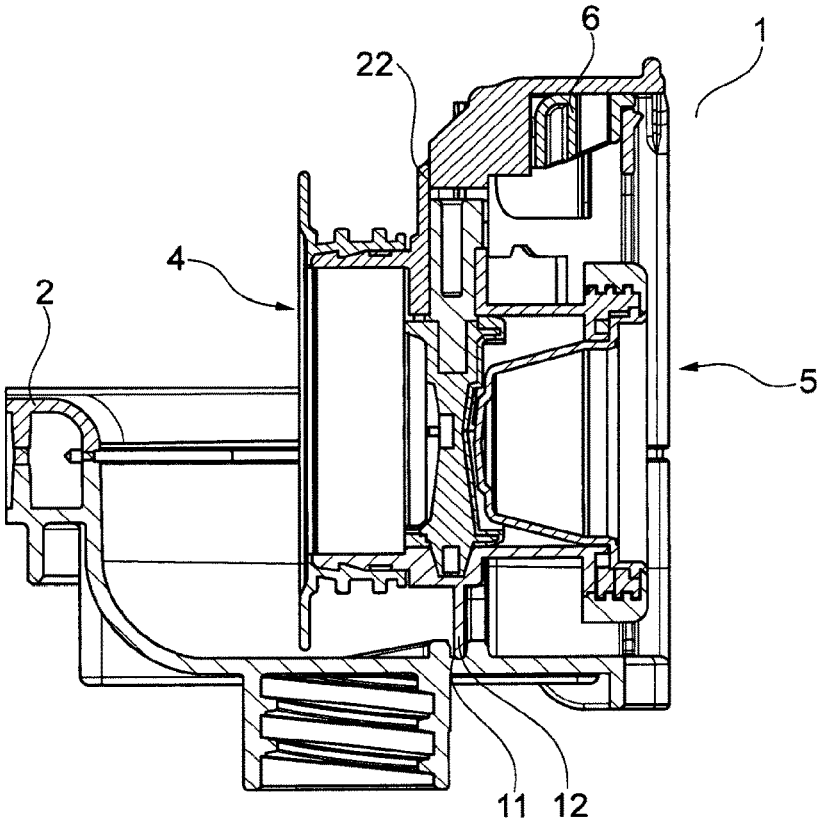
FIG. 9 shows a first sectional view of the valve assembly in an assembled/inserted state inside the valve socket of the container according to the preferred embodiment of the invention.
Figure 10:
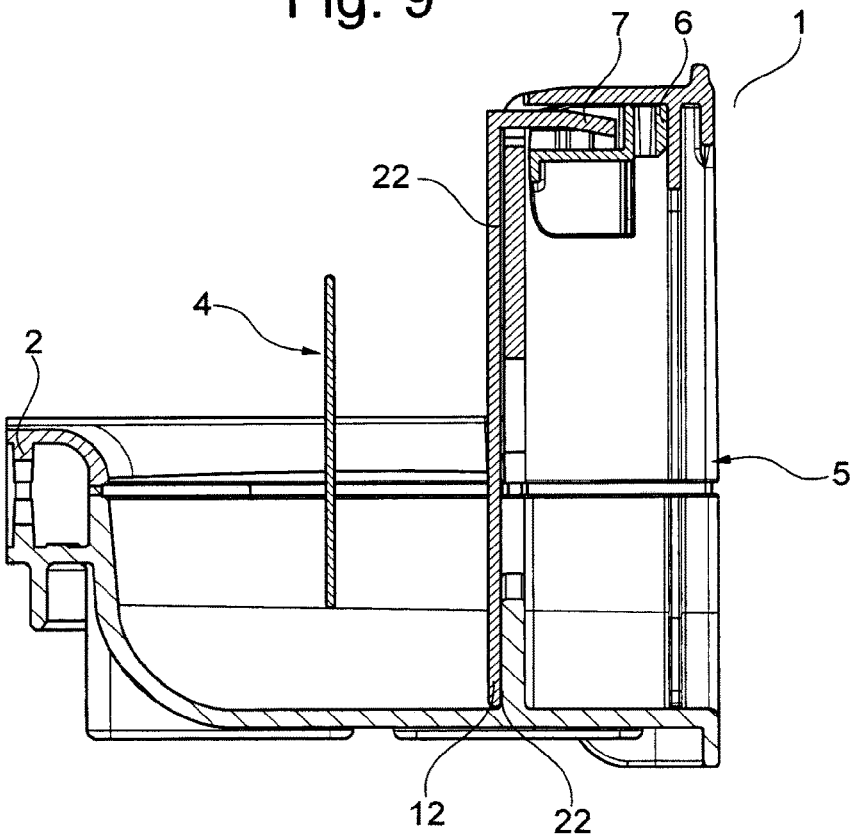
FIG. 10 shows a second sectional view of the valve assembly in an assembled/inserted state inside the valve socket of the container according to the preferred embodiment of the invention.
Figure 11:
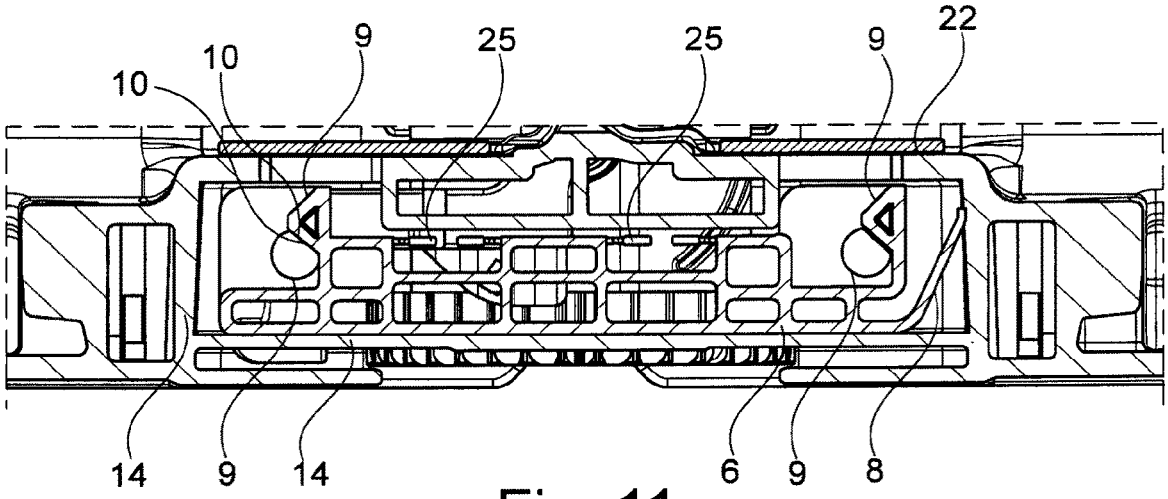
FIG. 11 shows a sectional view of the locking element in a closed position from above.
Figure 12:
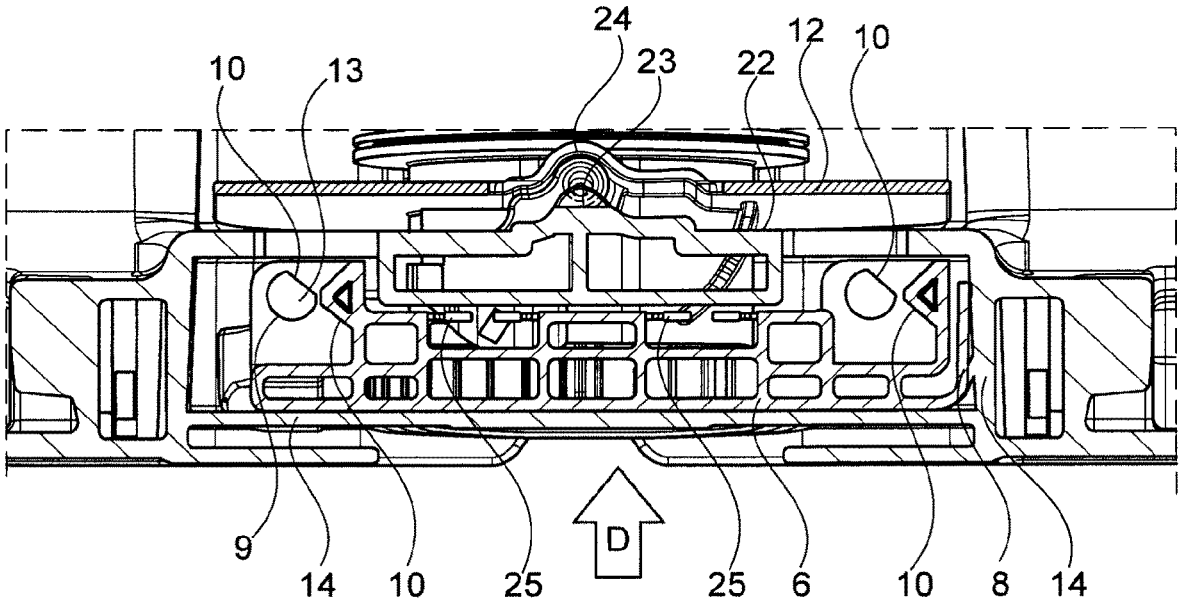
FIG. 12 shows a sectional view of the locking element in an open position from above.

As can be seen e.g. in FIGS. 9 and 10, the front face of the middle flange 12 of the valve assembly 4 may preferably act as a limit stop with a corresponding contact surface 22 of the valve socket 5. In the depicted preferred embodiment, a guiding groove 11 is provided in the base of the valve socket 5, which interacts with a guiding protrusion (in this case the middle flange 12) of the valve assembly 4, in order to guide the insertion movement of the valve assembly 4 in a defined tilting motion (as best seen in FIG. 7). As best seen in FIGS. 11 and 12, the valve socket 5 is provided with a centering protrusion 23 and the valve assembly 4 is provided with a complementary centering recess 24, which assist in centrally inserting the valve 4 into the valve socket 5. For toolless snap-fit assembly of the valve 4 into the valve socket 5, the main flange 12 of the valve 4 may be first inserted into the guiding groove 11 and subsequently the valve 4 may be tilted into the valve socket 5 (in an outwards direction) about the fulcrum formed by the guiding groove 11 and the main flange 12. The complementary centering protrusion 23 and centering recess 24 aid in perfectly aligning the valve 4 and the valve socket 5 in the transverse horizontal direction during said tilting motion, such that the locking structure 7 can easily connect and engage with the locking element 6.

Figure 3:
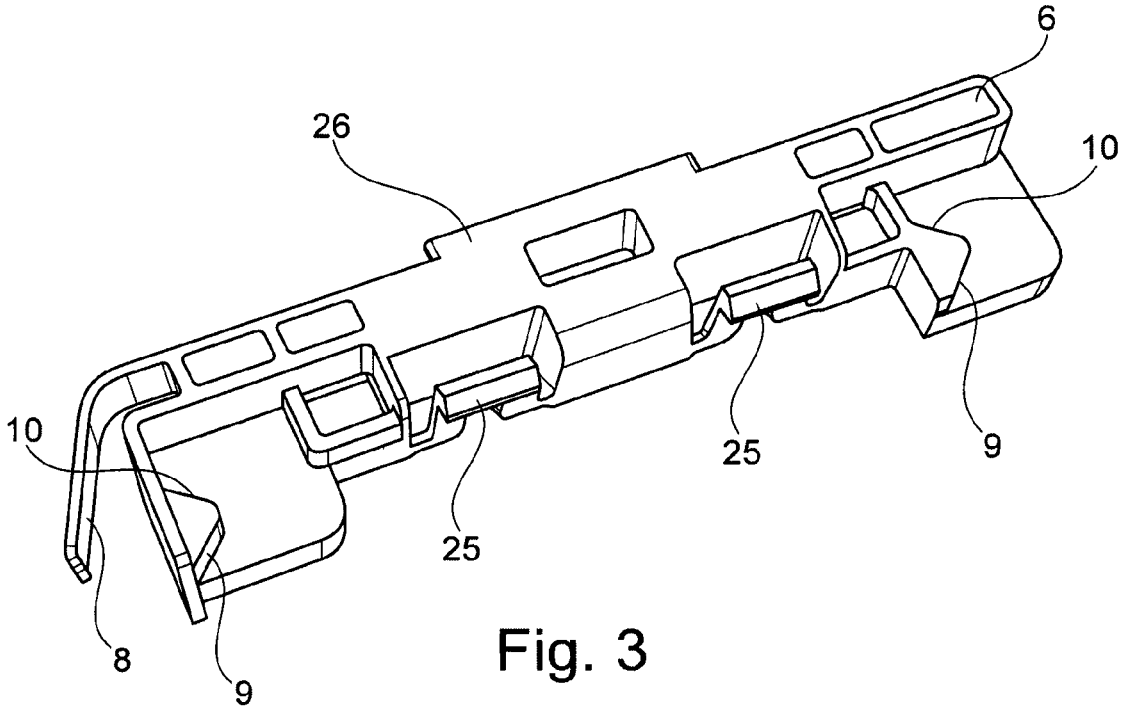
FIG. 3 shows a perspective view of a locking element according to the preferred embodiment.
Figure 13:
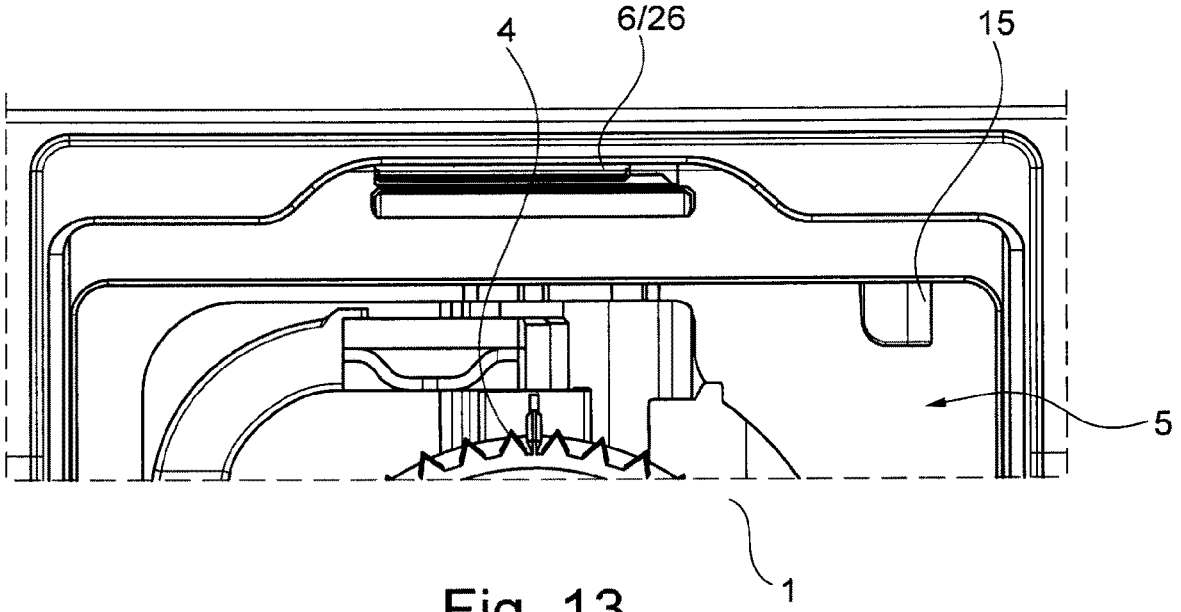
FIG. 13 shows a front view of the valve assembly in an assembled state inside the valve socket with the locking element in the closed position.
Figure 14:
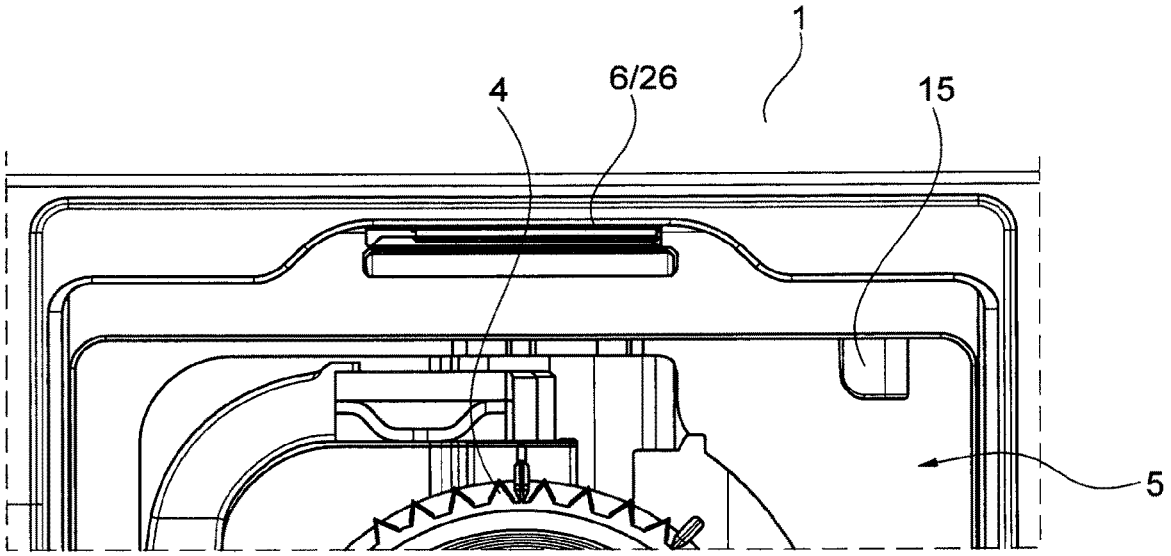
FIG. 14 shows a front view of the valve assembly in an assembled state inside the valve socket with the locking element in the open position.

The locking element 6 is best seen in FIG. 3 (perspective view), 11 and 12 (top view when assembled inside the container). The locking element 6 is movably mounted in a position in proximity to the upper edge of the valve socket 5. In particular, in the preferred embodiment, the locking element 6 is constructed as a slider mounted in a slide bearing or guiding rail 14 which is provided within the container side wall 3 above the valve socket 5. The depicted slider 6 is injection molded from POM material, which reduces its frictional resistance, such that it can easily slide between the closed and the open position within the slide bearing or guiding rail 14 (recess). The locking element 6 comprises a number of vertical guiding protrusions 25 and horizontal guiding protrusions 26, which interact with corresponding recesses or slots in the slide bearing 14, in order to secure the locking element 6 therein and to provide a defined and rattle-free movement/sliding of the locking element 6. The vertical guiding protrusions 25 also act as limit stops for limiting the sliding movement of the locking element 6 in its longitudinal direction and comprise snap-fit hooks at their free ends for snapping the locking element 6 into the slide bearing/guide rail 14. In particular, in the depicted embodiment a recess is formed in the upper side of the valve socket 5, which defines the slide bearing/guide rail 14 and into which the locking element 6 may be snapped from below by engaging the vertical guiding protrusions with complementary slots formed in the slide bearing/guide rail 14. The locking element 6 is configured to engage with the locking structure 7 of the valve assembly 4 in a (self-locking) snap-fit manner as will be described in greater detail later on. For this purpose, the locking element 6 is mounted on the container 1, such that it is movable between a closed (locked) position (left position in frontal view of the valve 4; c.f. FIG. 11 or 13) and an open position (right position in frontal view; c.f. FIG. 12 or 14). In the closed position the locking element 6 forms an undercut together with the locking structure 7 of the valve 4. One could also say that valve assembly 4 is constricted from being removed from the valve socket 5 by the locking element 6, when the valve 4 is inserted in the valve socket 5 and the locking element 6 is in the locked position. The biasing element 8, which biases the locking element 6 into the closed position inside the slide bearing 14, is realized as an integral leaf spring formed onto one of the longitudinal ends of the biasing ends. As can be seen in FIG. 12, when the locking element 6 is moved into the open position, the leaf spring 8 is compressed against the wall of the slide bearing/guiding rail 14, thereby urging the locking element 6 back into the closed position. The locking element 6 is constructed as an injection mounted component, which is optimized for production in one piece.

As can be seen e.g. in FIG. 1, the locking structure 7 of the preferred embodiment is constructed of two cantilever arms of sorts, which extend away from a front face of the main flange 12 in a forward (outward/insertion) direction of the valve assembly 4 and each form (perpendicular) downward projections 13 (taps, pins) at their distal ends. The locking element 6 and the locking structure 7 each comprise a pair of first guide surfaces 9, which forceably actuate a movement of the locking element 6 from the closed position into the open position (from left to right in a frontal view of the valve) in a perpendicular direction, when the valve assembly 4 is inserted into the valve socket 5 in the insertion direction (I). In other words, when the valve assembly 4 is pushed into the valve socket 5 the first guide surface 9 of its locking structure 7 glides off of the first guide surface 9 of the locking element 6 thereby pushing on the locking element 6 and causing it to yield and to move against the biasing force of the biasing element 8 into the open position, so that the valve assembly 4 is snapped into the valve socket 5. Once the valve assembly 4 sits inside the valve socket 5, the locking structure 7 (in particular the downward projections 13) has moved passed the obstructing portion of the locking element 6 and the locking element 6 moves back into the closed position under the influence of the biasing force. In the preferred embodiment, the locking element 6 (a second guide surface 10) stays in contact with the locking structure 7 after the valve assembly 4 has been snapped into the valve seat 5 thereby pinning the valve assembly 4 into the valve socket 5 can be seen e.g. in FIG. 10. One could say that the valve assembly 4 of the preferred embodiment is pinned between the locking element 6 and the contact surface 22 of the valve socket 5. In the depicted embodiment, the front faces of the downward projections 13 define the first guide surfaces 9 of the locking structure 7, which have a round or arcuate shape (c.f. FIG. 4). The first guide surfaces 9 of the locking element 6 are constructed as a notches or guide chamfers on the body of the locking element 6 which form an inclined surface with a 40° inclination with respect to the valve axis (c.f. FIG. 3 or FIG. 10).

Similarly, the locking element 6 and the locking structure 7 are provided with a pair of second guiding surfaces 10, which facilitate disassembling the valve 4 out of the valve socket 5. These second guide surfaces 10 forceably actuate a perpendicular movement of the locking element 6 from the closed position into the open position (left to right in a frontal view of the valve), when the valve assembly 4 is moved out of the valve socket 3 in a direction opposite to the insertion direction (I) with a predetermined disassembly/removal force. In the depicted preferred embodiment, the second guide surfaces 10 are designed as a pair of corresponding (parallel) notched (inclined) surfaces each having a 35° angle with respect to the valve axis. The second guide surfaces of the locking structure 7 of the valve 4 are formed as guide chamfers with said 35° inclination on the back face of the downward projections 13 (facing the main flange 12 of the valve 4; c.f. FIG. 4). The second guide surfaces 10 of the locking element 6 are configured as guide chamfers with the above mentioned 35° inclination on the backside of the first guide surfaces 9 of the locking element 6 (c.f. FIG. 3). As such, the second guides surfaces 10 of the locking element 6 form a notched pocket or undercut, in which the downward protrusions 13 of the locking structure 7 of the valve 4 are caught, when the valve 4 is snapped into the valve socket 5 (c.f. FIG. 10).

In a usual assembly process of the container 1 the valve assembly 4 will be inserted into the container 1 together with the liner bag (not shown) and the lower portion of the middle flange 12 will be inserted into the guiding groove 11 as best seen in FIG. 5. Then, the valve assembly 4 will be tilted forwards into the valve socket 3 in the insertion direction I). During this tilting motion the locking element 6 will yield into the open position while gliding off of the first guide surface 9 on the downward projection 13 of the locking structure 7 of the valve assembly 4 and will snap back in place under the force of the biasing element 8, once the locking structure 7 (the projection 13) has traveled past the guide surfaces 9, 10 of the locking element 6, thereby pinning the valve assembly 4 firmly into the valve socket 5.

Figure 8:
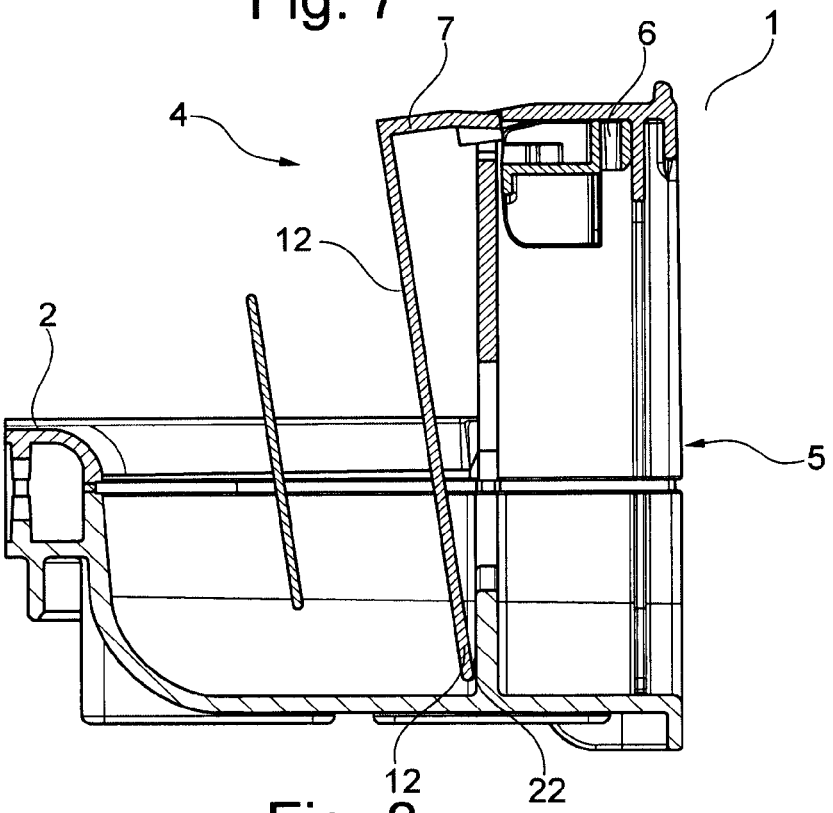
FIG. 8 shows a second sectional view of a valve assembly immediately before insertion into the valve socket of the container according to the preferred embodiment of the invention.

For disassembly, the user can simply kick against the valve 4 from the outside in the disassembly direction D, as best seen in FIG. 8. Again the locking element 6 is pushed into the open position (FIG. 11), in this case by the pair of second guide surfaces 10 gliding off one another. The more shallow inclination of the second guide surfaces 10 causes the force necessary for disassembly of the valve 4 to be greater than the assembly force. In the locking mechanisms known in the state of the art, the operator has to bend or crouch down and manually unlatch latching hooks formed on the valve 4 from the container. This operation requires both hands and bears the risk of injury for the operator. The above described disassembly by kicking provides a significant improvement in the ease of disassembly.

In the preferred embodiment an additional lever 15 is provided on the locking element 6, which extends to the outside of the container 1 through a recess and which is accessible in proximity to the valve outlet (on an outer face of the corresponding side wall 3), in order to enable manual movement of the locking element 6 from the closed position (left in a frontal view, c.f. FIG. 9) into the open position (right in a frontal view, c.f. FIG. 10) against the biasing force for assembly or disassembly of the valve 4. This feature allows for one handed disassembly of the valve assembly 4, which provides a substantive advantage over the latching mechanisms which are known in the state of the art.

Starting from the above described preferred embodiment, a container with an exchangeable valve assembly 4 may be altered in numerous ways without deviating from the invention.

For example the movable locking element may also be positioned on the valve assembly and the container may comprise a complementary locking structure. Also the exact position of the locking element/locking structure relative to the valve socket may be altered (below or lateral of the valve socket).

As the skilled person will appreciate the positions of protrusions and complementary recesses may be switched in many cases without altering the technical effect, e.g. with the guiding grove 11/guiding protrusion 12; the centering protrusion 23/centering recess 24 or the vertical and horizontal guiding protrusions 25, 26.

The invention claimed is:

1. A container comprising:

a container body having a base, at least one side wall, and a valve socket a valve assembly that is insertible into the valve socket in an insertion direction;

at least one locking element formed on a first component selected from the group consisting of the container body and the valve assembly; and a locking structure formed on a second component selected from the group consisting of the container body and the valve assembly, the second component being different from the first component, the at least one locking element being an exchangeable part that is separate from the container body and the valve assembly, the at least one locking element having a mounted state, in which the at least one locking element is configured for locking engagement with the locking structure, the at least one locking element being movably mounted in or on the first component so as to be movable relative to the first component between an open position, in which the valve assembly is insertible into or removable from the valve socket, and a closed position, in which the at least one locking element engages the locking structure to secure the valve assembly inside of the valve socket, the at least one locking element being biased into the closed position by a biasing element.

2. The container according to claim 1, wherein the biasing element is a spring.

3. The container according to claim 1, wherein the biasing element is a leaf spring integrally formed with the at least one locking element.

4. The container according to claim 1, wherein at least one of the at least one locking element and the locking structure comprises a first guide surface, which forcibly actuates a movement of the at least one locking element from the closed position into the open position, when the valve assembly is inserted into the valve socket in the insertion direction with a predetermined insertion force.

5. The container according to claim 4, wherein at least one of the at least one locking element and the locking structure comprises a second guide surface, which forcibly actuates a movement of the at least one locking element from the closed position into the open position, when the valve assembly is moved out of the valve socket in a direction opposite to the insertion direction with a predetermined removal force.

6. The container according to claim 5, wherein the first guide surface and the second guide surface are designed such that the predetermined removal force is greater than the predetermined insertion force.

7. The container according to claim 1, wherein the valve assembly is inserted into the valve socket through a tilting movement.

8. The container according to claim 7, wherein the valve socket comprises a guiding groove which interacts with a guiding protrusion of the valve assembly to guide the tilting insertion movement.

9. The container according to claim 1, wherein the insertion direction is directed from an inside of the container body towards an outside of the container body.

10. The container according to claim 1, wherein the locking structure comprises at least one locking protrusion that engages with the at least one locking element.

11. The container according to claim 1, wherein the at least one locking element is slideably mounted within a guiding rail.

12. The container according to claim 1, wherein the at least one locking element comprises a lever that is accessible from an outside of the container body for manually moving the at least one locking element from the closed position into the open position.

13. The container according to claim 1, wherein the container comprises a pallet container with a liner bag.

14. The container according to claim 1, wherein the at least one locking element is movable in a direction perpendicular to the insertion direction between the open position and the closed position.

15. A container comprising:

a base;

at least one side wall;

an exchangeable valve assembly that is insertible into a valve socket provided in the container in an insertion direction; and at least one locking element, the at least one locking element being movable between an open position, in which the valve assembly is insertible into or removable from the valve socket, and a closed position, in which the at least one locking element engages a locking structure of the valve assembly to secure the valve assembly inside of the valve socket, the locking element being a separate and exchangeable part that is movably mounted in or on the container and is configured for locking engagement with the locking structure of the valve assembly, or that is movably mounted in or on the valve assembly and is configured for locking engagement with the valve socket, and at least one of the locking element and the locking structure comprising a first guide surface, which forcibly actuates a movement of the locking element from the closed position into the open position, when the valve assembly is inserted into the valve socket in the insertion direction with a predetermined insertion force.

16. A container comprising:

a base;

at least one side wall;

an exchangeable valve assembly that is insertible into a valve socket provided in the container in an insertion direction; and at least one locking element, the at least one locking element being movable between an open position, in which the valve assembly is insertible into or removable from the valve socket, and a closed position, in which the at least one locking element engages a locking structure of the valve assembly to secure the valve assembly inside of the valve socket, the locking element being a separate and exchangeable part that is movably mounted in or on the container and is configured for locking engagement with the locking structure of the valve assembly, or that is movably mounted in or on the valve assembly and is configured for locking engagement with the valve socket, the valve assembly being insertable into the valve socket through a tilting movement, and the valve socket comprising a guiding groove which interacts with a guiding protrusion of the valve assembly to guide the tilting insertion movement.

* * * * *